United States Patent [19]

Hill et al.

[11] 4,449,116

[45] May 15, 1984

[54] ACTUATED DIGITAL PRETIMED TRAFFIC CONTROLLER

[75] Inventors: Frank W. Hill, Round Rock; William L. May; Willard L. Kent, both of Austin, all of Tex.

[73] Assignee: Gulf & Western Manufacturing Company, Southfield, Mich.

[21] Appl. No.: 326,226

[22] Filed: Dec. 1, 1981

[51] Int. Cl.[3] ..... G08G 1/07

[52] U.S. Cl. ..... 340/909; 340/916; 364/436

[58] Field of Search ..... 340/41 R, 31 R, 31 A, 340/35, 40; 364/436, 437

[56] References Cited

U.S. PATENT DOCUMENTS 3,763,466 10/1973 Howard et al. ..... 340/41 R
3,764,973 10/1973 Muramatu et al. ..... 340/40
3,886,496 5/1975 Spilo et al. ..... 340/41 R

FOREIGN PATENT DOCUMENTS 2381075 9/1978 France ..... 364/436

*Primary Examiner*—Gerald L. Brigance
*Attorney, Agent, or Firm*—Body, Vickers & Daniels

[57] ABSTRACT

In a digital pretimed traffic controller of the type used to control traffic signals at an intersection during a selected signal cycle there is provided an improvement wherein a demand signal, such as created by a detector, is directed to the controller. The demand signal is used for selecting one of a plurality of interval sequences within a fixed time cycle background. In this manner, the digital pretimed controller is compatible with electro-mechanical controllers and still retains traffic actuation versatility. The controller also is constructed to assure that the overall cycle length and the programmable individual interval times are identical before the particular timing plan can be accepted by the controller.

11 Claims, 15 Drawing Figures

SEQUENCE SYMBOLS (PROM)

G = GREEN BALL
Y = YELLOW BALL
R = RED BALL
W = WALK
FW = FLASHING WALK
D = DONT WALK
FD = FLASHING DT WLK

GL = GREEN LEFT ARROW
YL = YELLOW LEFT ARROW
RL = RED LEFT ARROW
GR = GREEN RIGHT ARROW
YR = YELLOW RIGHT ARROW
RR = RED RIGHT ARROW

FIG. 4

SIGNAL PLAN—CYCLE SEQUENCE CHART (1 OF 4)

| INTERVAL→ | 1 | 2 | 3 | 4 | 5 | 6 | 7 | 8 | 9 | 10 | 11 | 12 | 13 | 14 | 15 | 16 | 17 | 18 | 19 | 20 | 21 | 22 | 23 | 24 | FL |
|---|---|---|---|---|---|---|---|---|---|---|---|---|---|---|---|---|---|---|---|---|---|---|---|---|---|
| SIGNAL A | G | G | Y | R | R | → | → | → | R | → | → | → | G | G | G | G | R | → | → | R | → | → | → | G | Y |
| SIGNAL B | R | → | → | → | R | → | → | → | GL | GL | Y | R | GL | GL | Y | R | R | → | → | R | → | → | → | R | R |
| SIGNAL C | R | → | → | → | R | → | → | → | GL | GL | Y | R | R | → | → | → | GL | Y | R | R | → | → | → | R | R |
| SIGNAL D | G | G | Y | R | R | → | → | → | R | → | → | → | R | → | → | → | G | G | G | R | → | → | → | G | Y |
| SIGNAL E | R | → | → | → | G | G | Y | R | R | → | → | → | R | → | → | → | R | → | → | G | G | Y | R | R | R |
| SIGNAL F | W | FD | D | D | D | → | → | → | D | → | → | → | W | W | W | W | D | → | → | D | → | → | → | W | – |
| SIGNAL G | W | FD | D | D | D | → | → | → | D | → | → | → | D | → | → | → | W | W | W | D | → | → | → | W | – |
| SIGNAL H | D | → | → | → | W | FD | D | D | D | → | → | → | D | → | → | → | D | → | → | W | FD | D | D | D | – |

C
60
REMOTE
P1 P2
D1 D2
PRE EMPT
DETECTORS
52
EPROM
RAM
54
56
I/O
PROCESSOR (CPU)
50
68
OFFSET
66
SIG. PLAN
DIAL
62
SPLIT
64
70
SIGNALS
A B C D E F G H

CYCLE LENGTH
INTERVALS
1
2
3
4
5
6
7
CL = ΣINT1-N

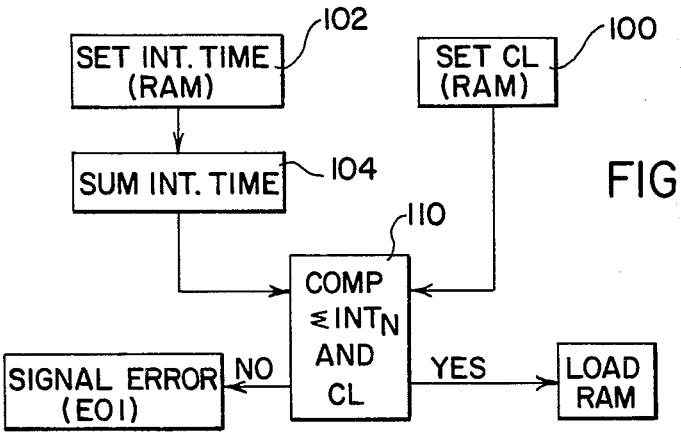
FIG. 7
FIG. 8
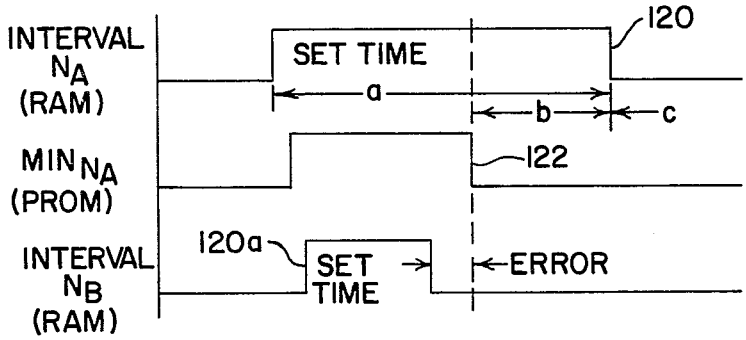
FIG. 9
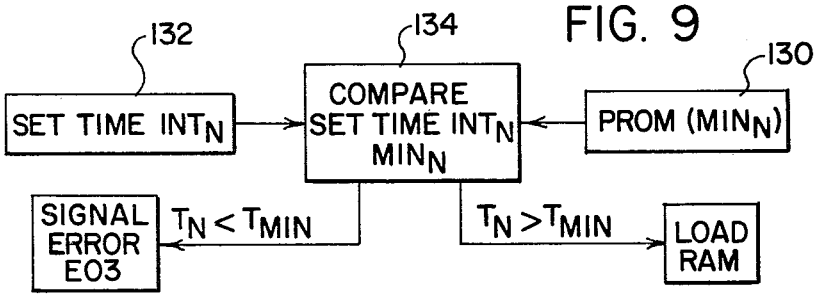

ACTUATED DIGITAL PRETIMED TRAFFIC CONTROLLER

The present invention relates to the art of controlling traffic at an intersection and more particularly to an actuated, digital pretimed traffic controller.

BACKGROUND

It is standard practice to provide devices for controlling the signals at a traffic intersection so that the traffic flows through the intersection in a preselected pattern. Such devices or controller are often located at the intersection and may be coordinated with similar controllers at other intersections by a master traffic controller. Although many intersections located or local controllers and their coordinating master controllers now employ solid-state digital technology, one of the most commonly used traffic controller is a relatively simple pretimed unit. These controllers have a preselected signal pattern which is processed repeatedly to control signal energization at an intersection. Similar pretimed controllers are located at other intersections. To coordinate these controllers for smooth traffic flow, the cycles are often offset by an amount or time determined by the desired traffic flow. To accomplish this offset coordination, synchronization pulses created by the master controller are directed to the various pretimed controllers at the intersections. These pretimed controllers generally involve the signalization at an intersection which includes a high volume street, known generally as the main street, and a lower volume street, known generally as the cross street. The ratio of time or cycle portion dedicated to the main street and the cross street is referred to as the split and is controlled at a given intersection by existing pretimed controllers. In summary, a local traffic controller of the pretimed type can include control of the offset, the split, the dial (timing plan) and cycle length.

For a number of years, the pretimed traffic controllers located at an intersection were electro-mechanical devices. Electric motor continuously rotated one or more interval controlling devices, referred to in the trade as dials. A single rotation of the dial was a cycle which had a length or duration determined by the speed of a drive motor and the ratio of gears connecting the drive motor and the rotating dial. To control the cycle length, the speed of the motor could be changed. More commonly, the gearing between the motor and the dial was changed to control the cycle length. The general concept is shown in Hendricks U.S. Pat. No. 3,047,338 as it related to a cycling of a master controller. The signal plan of the local pretimed controller was determined by a camshaft which operated the traffic signal lights in accordance with the position of the camshaft. The camshaft was indexed or stepped from position-to-position by tabs located at spaced positions on the dial.

Each index of the camshaft was referred to as an interval. Each interval would control the condition of the lights at the intersection in accordance with the position of cams on the camshaft, as they opened and closed switches used to energize the traffic lights. The length or time duration of each interval in the signal plan, as determined by the camshaft, was controlled by the time between a step starting the internal and the next step stopping the internal. The spacing of these steps was referred to as a percentage of a single rotation on the dial in a cycle. Thus, during the single cycle of a pretimed controller, the camshaft is indexed through a signal plan which controlled the various signal lights in accordance with a preselected, fixed pattern. The time of all intervals, when added together, equal the cycle length determined by single rotation of the dial. In more sophisticated electro-mechanical units, two or more dials could be provided, having different cycle length and/or different spacing of the tabs to index the camshaft through its signal plan. One of the dials could be used to change the split between signalization of a cross street and main street. In some controllers, more than one camshaft was provided. Each of these camshafts would have its own signal plan.

In summary, the standard, commonly used pretimed controllers included a camshaft which would determine the signal plan. A dial was rotated by a constantly rotation motor to control the cycle and the time during which the camshaft was in each indexed position or interval. This type of electro-mechanical device was generally fixed in operation and could not be varied substantially, except to control coordination, offset and similar features.

In recent years, traffic controllers have steadily progressed from electro-mechanical devices, to electronic devices and then to digital, solid-state devices. With the advent of microprocessors, the digital traffic controllers have been gradually shifting to programmable controllers with the executive program permanently stored in a PROM. Thus, traffic controllers now being produced are usually digital and programmed for process or control. Most of these devices are traffic actuated or modified. With the capabilities of complex programming, the units are not pretimed. This presents compatibility problems when the previous pretimed units are to be replaced by a controller of the present technology. Most of the local controllers with the programmable type are too expensive to be used as a pretimed unit or controller. In addition, such units have not heretofore been available as a direct replacement for a pretimed, electro-mechanical controller. For these reasons, relatively expensive programmable units are being employed at localities which require the only relatively simplified pretimed capabilities. In some instances, pretimed controllers of the electro-mechanical type are being used. These also present substantial cost. In either instance, the results are not satisfactory. An expensive programmed unit with too many variables in operation are not compatible with existing pretimed controllers. New electro-mechanical controllers are too expensive and involve technology not always wanted by a traffic engineer.

There is a need for a programmable pretimed controller. Efforts to develop such controllers have generally involved only units to provide in digitized versions of an electro-mechanical controller. This precludes any versatility and causes certain compatibility problems. Also, these units did not have any flexibility which could be obtained without complicated programming.

INVENTION

The present invention relates to a solid-state, digital, programmable pretimed traffic controller which is compatible with electro-mechanical pretimed controllers and also has certain amounts of actuation capabilities that do not complicate the programming or pretimed operation of the controller.

In accordance with the invention, there is provided an improvement in a digital, pretimed traffic controller of the type used to control traffic signals at an intersection during a selected signal cycle. The type of controller to which the present invention is an improvement includes a central processing unit, a read only memory means for storing the executive program for the controller and also a plurality of programmed solid-state camshaft simulating signal plans, each of which has a number of distinct intervals to be processed in sequence during the cycle of the controller, a random access read/write memory means for storing a rotary dial simulation timing plan having stored duration times for each of the distinct intervals of each of the signal plans as stored in the read only memory means, an external cycle select means for activating one of the signal plans and one of the timing plans for processing by the controller in accordance with the stored executive program and an interfacing means for controlling the condition of the traffic signals in accordance with the selected cycles being processed by the controller. The improvement in this type of programmable pretimed traffic controller is the provision of means for directing a demand signal to the controller, means for providing plurality of interval sequences in a portion of the selected cycle being processed and means for selecting one of the interval sequences in response to the demand signal. In this manner, the pretimed cycle being processed by the controller may include one of several sequences of different intervals. This modifies a standard controller used to duplicate a pretimed controller by allowing certain actuation capabilities. Different interval paths may be followed during a given cycle being processed by the programmable pretimed controller. An interval set is selected by an external demand signal such as created by a vehicle detector.

In accordance with another aspect of the invention, the given cycle being processed includes a selected portion having obligatory intervals. The separate interval paths or sequences occur as programmed with the obligatory intervals.

In accordance with still another aspect of the present invention, the cycle length of the pretimed controller is fixed and the summation of the various intervals of the cycle must equal the set cycle time or length before a signal plan can be inserted into the memory units of the controller. The cycle length is set at a known time. In this manner, the controller is pretimed and is compatible with a fixed cycle length pretimed, electro-mechanical controller. This feature allows for direct replacement of existing electro-mechanical controllers by the new programmable controller. In the past, the cycle lengths of solid-state controller would vary according to the summation of the intervals of a cycle. In the present invention, the summation of intervals must equal the cycle length so that the fixed cycle length is compatible with other traffic controllers of the pretimed variety.

In accordance with still another aspect of the present invention, a pretimed programmable controller, as defined above, is provided with means for receiving a pre-emption signal and means responsible to the pre-emption signal for shifting from one signal plan to another signal plan. In this manner, a pre-emption signal plan may be provided for processing by the controller when a pre-emption condition exists, such as an emergency vehicle, a train, a drawbridge, etc. By receiving a pre-emption signal indicative of a pre-emptive condition, the present invention can shift into a preselected signal plan designated as a pre-emption plan for signalization in accordance with a fixed cycle compatible with other pretimed controllers. In this manner, the solid-state, digital controller is provided with a pre-emptive capability not heretofore used in programmable local pretimed controllers.

A still further aspect of the present invention is the provision of a method of controlling traffic signals at an intersection by using a digital, pretimed traffic controller of the type described above. This method includes the steps of detecting a traffic condition at the intersection, progressing signalization during the selected cycle in a given sequence of intervals in accordance with the detected condition, and controlling the signals in accordance with the given sequence of intervals in a selected cycle. Thus, for a given cycle, the interval path can be varied according to the demand inputs to the ciontroller. Heretofore, pretimed solid-state controllers of the type employing soft-ware camshaft simulating signal plans did not have the capability of modifying intervals during a preselected signal being processed by the controller. In this manner, the pretimed controller is made actuatable by providing a finite number of preselected paths in a given pretimed cycle. This has not been done before in electro-mechanical devices nor in the solid-state adaptations of these electro-mechanical devices. This concept provides versatility to a solid-state device without the complexity of a fully actuated traffic controller of the type often used at an intersection.

The primary object of the present invention is the provision of a programmed, pretimed traffic controller which simulates an electro-mechanical controller and has certain actuation characteristics.

Still a further object of the present invention is the provision of a solid-state, pretimed traffic controller, which controller has selected cycles each of which has separate branches or paths formed by a plurality of successively timing intervals and an arrangement for selecting different branches or interval paths during a given cycle.

Another object of the present invention is the provision of a programmable pretimed traffic controller, which controller has cycles with a preselected, fixed duration that may be processed in accordance with selectable paths or groups of intervals each corresponding to a different timing pattern of a preset signal plan.

Still another object of the present invention is the provision of a solid-state, digital pretimed traffic controller, which controller can be used as a direct replacement for existing electro-mechanical traffic controllers.

A further object of the present invention is the provision of a solid-state traffic controller, as defined above, which controller is compatible with existing electro-mechanical controllers so that the use of this controller system including electro-mechanical controllers is possible without special coordination.

Still another object of the present invention is the provision of a solid-state, pretimed digital traffic controller which has a pre-empt interrupt capability to interrupt at special locations in a fixed cycle of the pretimed controller.

Still a further object of the present invention is the provision of a controller of the digital, pretimed type having a fixed signal plan or plans wherein a pre-empt entrance interval can be used in one of the cycles to shift from one signal plan to another signal plan upon request from a preemption signal.

Still another object of the present invention is the provision of a solid-state traffic controller of a pretimed, digital type which includes signal plans that are fixed to simulate the operation of a mechanical camshaft which plans provide flexibility to accept a pre-empt signal such as created by an emergency vehicle, railroad, drawbridge, etc.

Still a further object of the present invention is the provision of a solid-state traffic controller, of the type defined above, which traffic controller has timing intervals which may be loaded into a random access memory and may be updated from the front panel without the use of complex mechanical reading devices, such as thumb wheels. Another aspect of this object is the provision of a minimum time for each of the various signal intervals, which minimum time is permanently stored in the read only memory of the traffic controller so that the interval time cannot be less than the minimum stored interval time.

Another object of the present invention is the provision of a method of controlling traffic by a traffic controller of the type defined above having the features defined in the object set forth above.

These and other objects will be advantageous and become apparent from the following description taken together with the accompanying drawing.

DRAWINGS

FIG. 4 is a part of a signal plan used in the present invention adapted for implementation of the signalization for an intersection, such as shown in FIG. 2;

FIG. 7 is a flow chart of program steps utilized in another aspect of the present invention;

FIG. 8 is a graph showing characteristics for an interval to be used in a timing cycle of the preferred embodiment of the invention;

FIG. 9 is a flow chart illustrating another aspect of the present invention.

FIG. 1 is an interval chart similar to FIG. 10 illustrating actuatable or selectable interval paths, branches or patterns in a fixed cycle, as employed in the present invention;

PREFERRED EMBODIMENT

Figure 1:
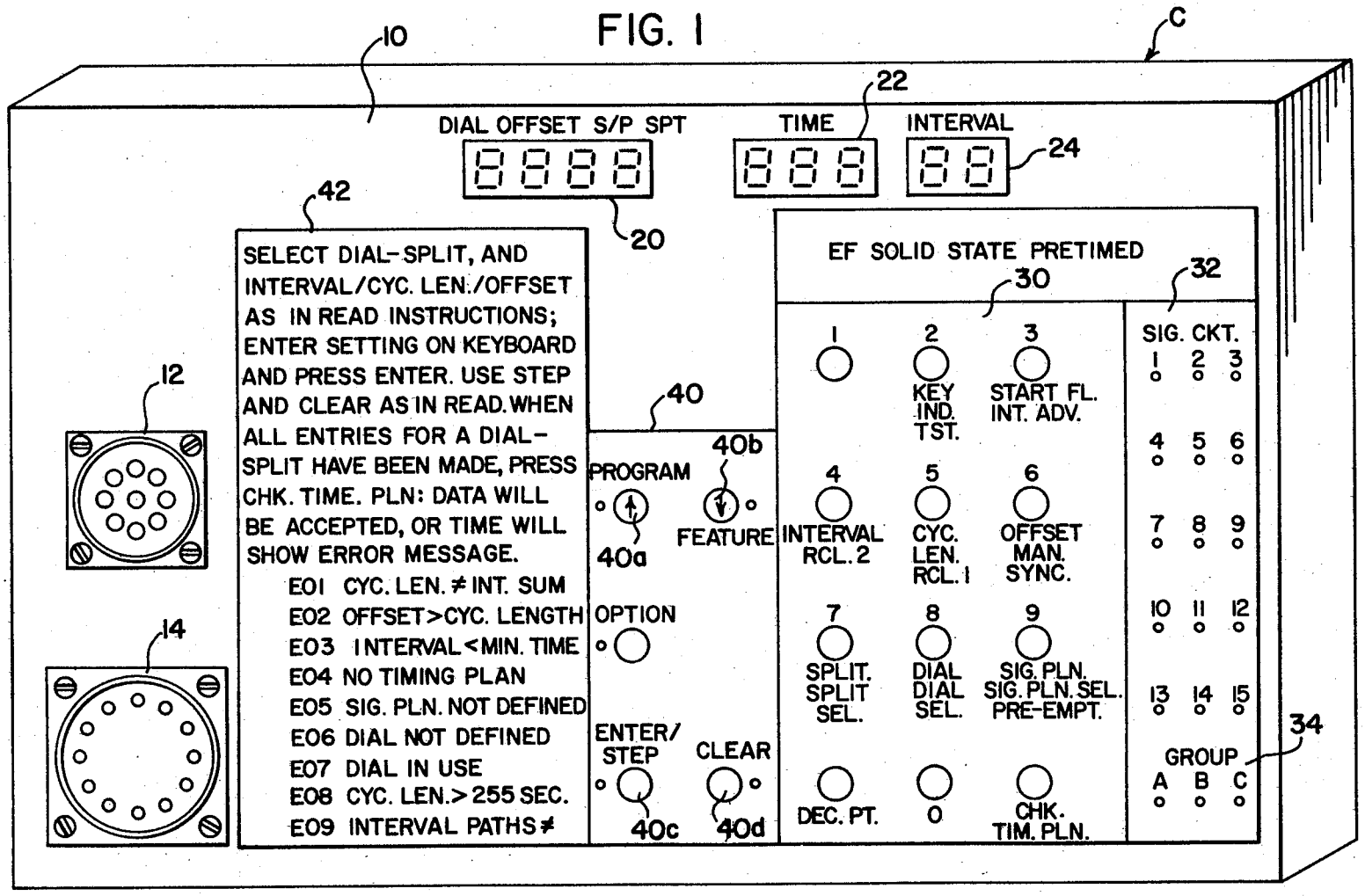
FIG. 1 is a pictorial view showing the front panel of a traffic controller incorporating the present invention.
Figure 2:
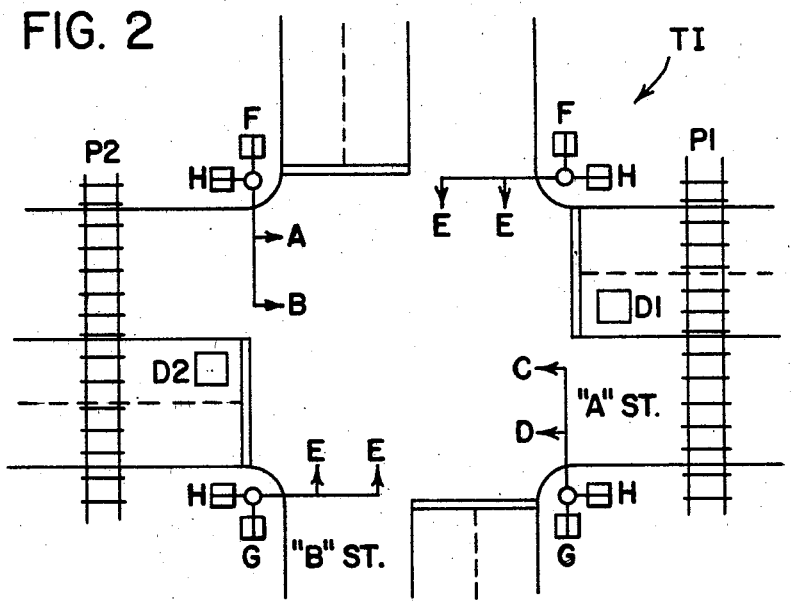
FIG. 2 is a schematic view of a traffic intersection of the type which can be controlled by the present invention.
Figure 3:
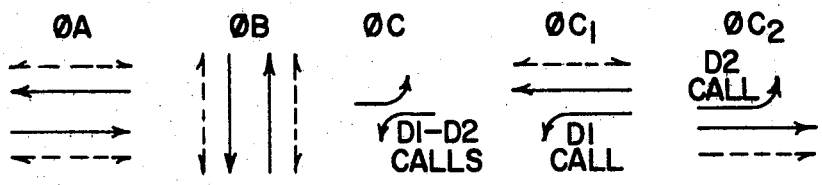
FIG. 3 is a series of traffic flow charts presenting various traffic patterns or phases allowable by the signalization at the intersections schematically represented in FIG. 2.

Referring now to FIGS. 1–5, a controller C constructed in accordance with preferred embodiment of the present invention, is employed for controlling the signal at the traffic intersection TI shown in FIG. 2 in accordance with selected signal plans, one of which is shown in FIG. 4. Referring more specifically to the traffic intersection TI, this intersection includes a plurality of signals designated A, B, C, D, E, F, G and H. The illustrated signals have the same letter designations and are controlled in unison. In accordance with the illustrated traffic intersection, there are two detectors, D-1, D-2 in the main street "A". Two separate railroad tracks are illustrated running parallel to side streets "B" and produce a pre-empt request signals designated P-1 and P-2, respectively. Upon receipt of calls from detectors D-1, D-2, phase "C" traffic is allowed as illustrated in FIG. 3. This phase involves a double left turn. In response to a call from only detector D-1, a left turn signal "B" is energized. This is represented as phase C1 in FIG. 3. In a like manner, a call from detector D-2 creates a left turn signal "C" to be initiated in accordance with the signal plan as schematically illustrated in FIG. 4. This is phase C2. Control of traffic at traffic intersection TI is in accordance with standard traffic control concepts and is shown as illustrative of an intersection arrangement controlled by a solid-state, pretimed controller C. In accordance with standard practice, the pretimed controller C has a plurality of signal plans. In practice four, different signal plans are controlled by controller C. These signal plans are schematically illustrated in FIG. 4 wherein interval Nos. 1–24 are indicated at the upper portion of the chart. Signals A through H, as illustrated in FIG. 2, are set forth in a vertical column on the signal plan chart. As can be seen, during each interval, a certain array of signal energizations is effected. The intervals have varying time durations. This is the same as a camshaft which is indexed from interval-to-interval by electro-mechanical stepping from a rotating dial, as generally illustrated in Hendricks U.S. Pat. No. 3,047,838. Each of the four signal plans is permanently programmed into controller C and represents the digitalization of a different camshaft operation. In other words, the signal plans simulate indexing of a fixed camshaft from position-to-position as accomplished in prior electromechanical pretimed controllers. If the signal plan illustrated in FIG. 4 is selected by controller C for use in the signal control of traffic intersection TI, intervals will be progressively performed during a single cycle of the controller.

Figure 5:
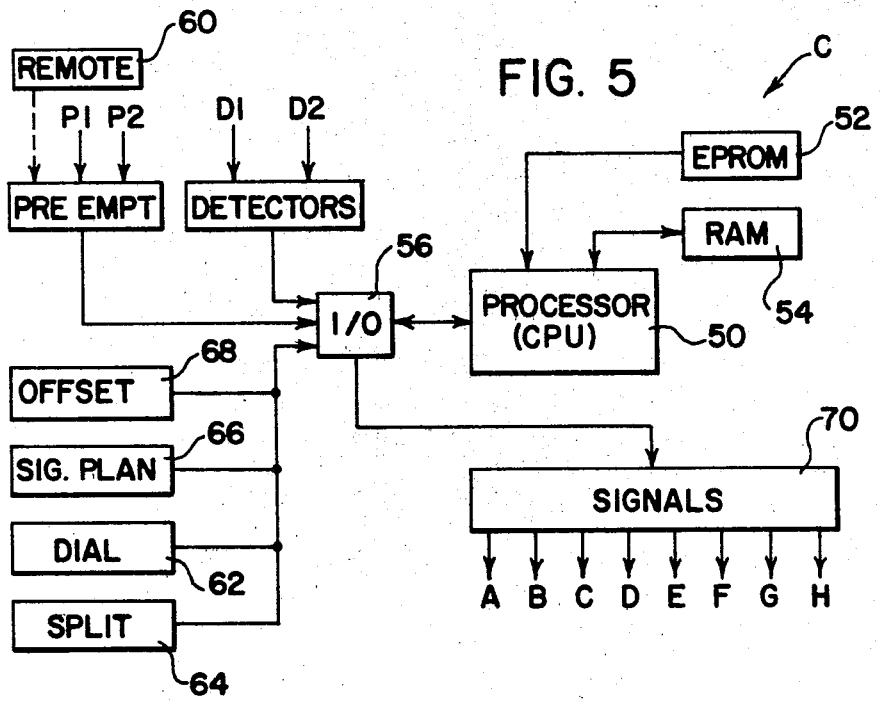
FIG. 5 is a blocked diagram illustrating the preferred embodiment of the present invention.

Referring now to FIG. 5, there is a schematic layout of the controller C, as employed in practice. In accordance with this layout, a standard micro-processing programmable controlled system 50 utilizes permanently stored data in a EPROM or read only memory unit 52 and temporarily stored digital data in a RAM or random access memory unit 54. In accordance with solid-state technology for traffic controllers, the executive program is stored in the EPROM 52. RAM 54 is used for temporary storage of intermediate data or data which is readable by the front panel switches during processing of traffic signalization by controller C. In accordance with the present invention, the EPROM 52 stores the number of intervals (up to 24) and the minimum time for each of the intervals, together with the signal plans, one of which is shown in FIG. 4. This information, together with the type of offset correction, is programmed at the factory and remains constant during the operation of controller C at intersection TI. The random access memory unit 54 is employed for temporarily storing the cycle length CL, the intersection split SP and three distinct offset which can be called up by input signals in accordance with standard practice. A somewhat standard input/output interface unit 56 is employed with micro-processor unit 50 to direct the detector signals D-1, D-2 and pre-empt signals P-1, P-2 to the microprocessor.

In accordance with the present invention, an external source is used for selecting the particular dial and split for processing by controller C at any given time. Such selection is common practice and does not form a part of the present invention. Cycle selection can be received from external sources or can be manually controlled at the intersection. A standard dial select signal is represented by block 62. A standard split signal is represented by block 64. The particular signal plan is selected, as schematically represented by block 66, and an offset is selected, as schematically represented by block 68. In accordance with the present invention, a remote pre-empt signal creating device 60 can be a radio transmission, a telephone line or other interconnecting arrangement. This remote pre-empt signal creation device would be used in place of one of the pre-empt signals P-1, P-2. Thus, a pre-empt interrupt signal can be received from a remote location or from an adjacent traffic condition, such as railroad track or drawbridge. To change from one cycle to another, interface device 56 receives the dial and split data together with the signal plan and offset data. It then determines the particular signal plan being processed at any given time by controller C by the program in EPROM 52. This is in accordance with standard practice and does not form a part of the present invention. The present invention relates to the concept providing a solid-state, pretimed digital traffic controller of the programmed type for mounting at the intersection which controller rigidly follows the dictates and characteristics of an electro-mechanical controller with certain limited actuation characteristics that do not affect the pretimed aspect of the controller. The actuation features allow selection of paths through the branches of intervals in a fixed cycle and interruption by a pre-emption request signal. These features will be described in detail with respect to the present invention. Interface unit 70 controls signals A-H in accordance with standard practice. This involves storing signals at various output terminals for controlling the condition of the various signals. Some of the signals include green, yellow and red; therefore, they require three separate outputs to determine the exact condition of the signals.

The signalization determined by the operation of controller C is displayed and/or changed by a traffic engineer from a front panel 10 as shown in FIG. 1. This panel includes standard couplings 12 and 14 for connecting the controller to the outside world, which includes signals A-H, detectors D-1, D-2, pre-empt input signals P-1, P-2 or optional signal device unit 60. Also, cycle selecting signals in devices 62–68 are electrically coupled to controller C. Front panel 10 could take a variety of forms; however, in accordance with the illustrated embodiment of the invention, display units 20, 22, and 24 are used to display various information used in monitoring the operation of controller C or programming the random access memory 54 of the controller. Display unit 20 has four digits to indicate the dial, offset, signal plan and split for the cycle being processed or being used in programming controller C by the traffic engineer. In practice, the dial digits relate to one of four timing plans available in controller C. These timing plans correspond to the electromechanical rotating dial which has tabs at certain percentage locations so that a single rotation of a dial concludes a single cycle and the tabs indicate when the camshaft will be indexed to the next interval. A camshaft is digitized into a signal plan and permanently stored in EPROM 52 as separate intervals which can be indexed in succession in the same manner as a camshaft in an electro-mechanical device. It is appreciated that indexing of an electro-mechanical device can only be in the advancing direction, as opposed to selecting intervals in a random fashion. Thus, intervals must be progressed in sequence through a signal plan such as from interval No. 1 to interval No. 24 in the plan schematically in FIG. 4. Offset digits are shown in display unit 20 to indicate the offset being processed or programmed. The S/P digit of display device 20 indicates the particular signal plan being processed by controller C or being programmed. The split digit in display unit 20 indicates the split identification number of the particular cycle being processed or programmed. Display unit 22 indicates the lapse time for a given cycle during operation of the controller. During programming, display unit 22 exhibits the set time of an interval or offset time to be loaded into memory during programming. Display unit 24 indicates the particular interval by number designation.

Figure 15:
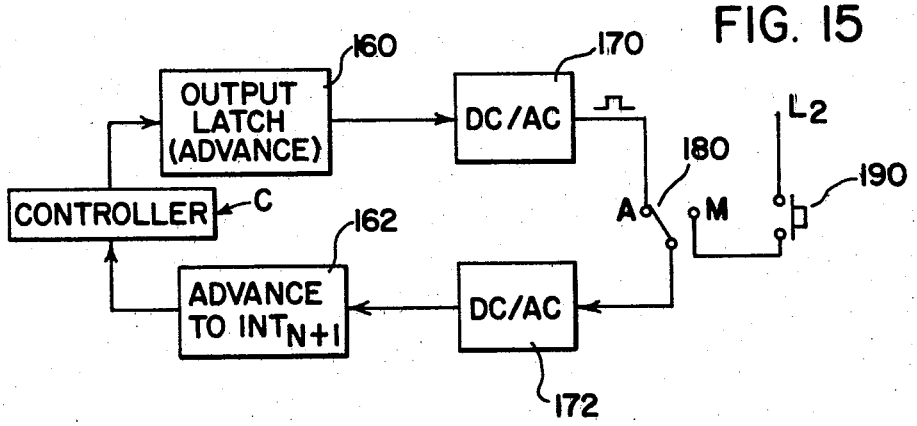
FIG. 15 is a combined block diagram in switching network showing an aspect of the present invention which also affects the compatibility with existing electro-mechanical pretimed controllers.

In the illustrated embodiment, a selector key pad 30 is employed for selecting a particular feature or for programming a given feature. The key pad includes numbers for selection of digits as shown in displays 20, 22 and 24. Interval display network 32 includes fifteen separate signal circuit indicators which are multiplexed by a designation in network 34. Thus, forty-five separate signal circuits can be displayed by the network 32 in conjunction with one of the three lights in network 34. Key pad 40 is used for selecting a display or programming. Arrows on the upper buttons **40*a* and 40*b* indicate which of the designations on key pad 30 are called by depressing keys 40*a*, 40*b*. PROGRAM button 40*a* is depressed, the upper designation from the buttons on key path 30 are selected. To call up the lower designations, FEATURE button 40*b* is depressed. Button 40*c* is used to enter data into RAM unit 54 or to step from interval-to-interval in a Signal Plan. Plate or label 42 indicates operation of the various elements on panel 10 and provides the designation of error codes EO1–EO9 used in the preferred embodiment of the present invention. Upon the receipt of an error code, data is not insertable into RAM 54. As an example, the operation of the elements shown on front panel 10 of controller C will be illustrative. To display the Signal Plan, PROGRAM button 40*a* is depressed. Then button "9" is depressed following with buttons "1" and "4". This then calls up the particular signal Plan, such as shown in FIG. 4. Thereafter, button "4" is depressed to call up the interval followed by the number of the interval. In this manner, the interval number will be shown in display 24. The minimum time for that interval will be shown in display 22. Signal circuit networks 32 and 34 will indicate whether or not the signal is actuated. By pressing button 40***c*, the intervals will be advanced. In this manner, all intervals of any signal plan can be progressively displayed as to their minimum duration which is stored permanently in EPROM 52. To display the timing plan, button 40*a* is depressed. Thereafter, dial button "8" in pad 30 is depressed. This is followed by the dial number on pad 30. Then split button "7" is depressed, followed by the split number. This calls up the timing plans stored in RAM unit 54. The intervals in RAM can be displayed by depressing interval button "4" followed by the interval number. If the cycle length is required, the controller is cleared by pressing button 40*d*. Cycle length button "5" is then depressed. After an additional, clear, depressing offset button "6" and the offset number will display the offset being processed. Again button 40*c* can step through the intervals or through the offset numbers. Depressing the CLEAR button 40*d* clears the display. This button can be pushed the second time to restore the operating display. To advance controller C from the front panel, button 40*b* is depressed. Thereafter, the interval advance button "3" is depressed. This enables the front panel to be used for advancing to the next interval, unless the manual advance concept shown in FIG. 15 is being used. After all programming features have been entered into temporary storage by button 40*c*, the CHK. TIM. PLN. button is depressed to check conformity to set parameter before entry into permanent storage. Other features of the control are selected in accordance with this practice. This illustrates the practical implementation of the present invention and is disclosed only to show the environment and general use of a controller used to practice the present invention. Other panel concepts could be used to practice the invention.

Figure 6:
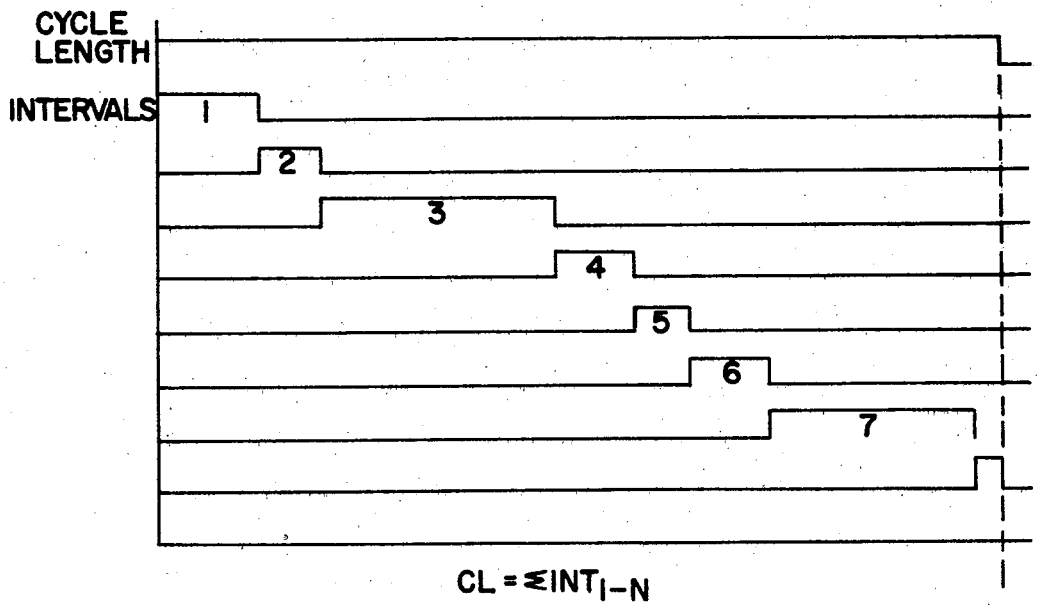
FIG. 6 is a chart illustrating the characteristic of a preferred embodiment of the present invention.

Referring now to FIGS. 6 and 7, one concept used to practice the invention is disclosed. In the procedure for setting up the timing plan in RAM for a given cycle, the duration of each of the intervals in a signal plan is set by the front panel. The time duration of these intervals is depicted schematically in the graph of successive intervals in FIG. 6. All of these intervals are added to assure that cycle length CL is equal to the summation of the various intervals being processed during a given cycle. This process using controller C is set forth schematically in FIG. 7 wherein the preselected cycle length is entered at front panel 10 as indicated by block 100. Thereafter, the desired duration of an interval of the timing plan is loaded into RAM and button 40*c* is depressed. This indexes controller C to the next interval during the front panel programming process. In practice, the program in EPROM accumulates the total duration of the successive intervals as loaded temporarily into RAM and produces a summation time schematically represented as block 104. This total interval time is compared with the cycle length time CL, as represented by block 100. If there is no difference between the accumulated or total time of all of the intervals and the set cycle length, a conformity of YES command is received from the comparison unit 110. This stores or loads all timing information into RAM for use by controller C. If there is no comparison, then an error signal appears in display 22. In this instance, the error signal would be EO1. In this manner, the cycle length, which is the compatibility time with respect to electro-mechanical controllers, is a limiting factor for entry of the separate and distinct time durations for the signal plan intervals to be processed during a cycle. This procedure is done for all cycles to be processed by controller C to complete the front panel programming of the pretimed controller. In the past, the intervals have been set into RAM without regard for a master overriding set cycle length. By having a mandatory cycle length, compatibility is assured in a system combining controller C with standard electro-mechanical controllers.

Another aspect of the invention is schematically illustrated in FIGS. 8 and 9. Pulse or signal 120 has a selected duration for a preselected interval NA. The pulse or signal 122 represents the minimum time for this particular interval (NA). Since the selected time of pulse 120 exceeds the minimum time 122 set in PROM 52, entry of the time associated with interval duration 120 is possible. The constrictions of the concepts disclosed in FIGS. 6 and 7 must be met. However, if the duration of an interval attempted to be entered into RAM is selected as represented by pulse 120*a*, an error signal is created and indicated display 22. The duration of pulse or signal 120*a* is less than the minimum set duration of signal 122. This concept is schematically illustrated by individual programmed steps shown in FIG. 9. Block 130 indicates the minimum time or duration of a selected interval of a given cycle is permanently stored in PROM 52 for a given signal plan. The selected or set interval time is represented by block 132. These two times are compared by central processing unit CPU in accordance with the executive program stored in PROM 52 so that either an error signal is created in display 22 or a load signal is created which allows loading of the set interval time into RAM 54 for subsequent processing by controller C.

Figure 10:
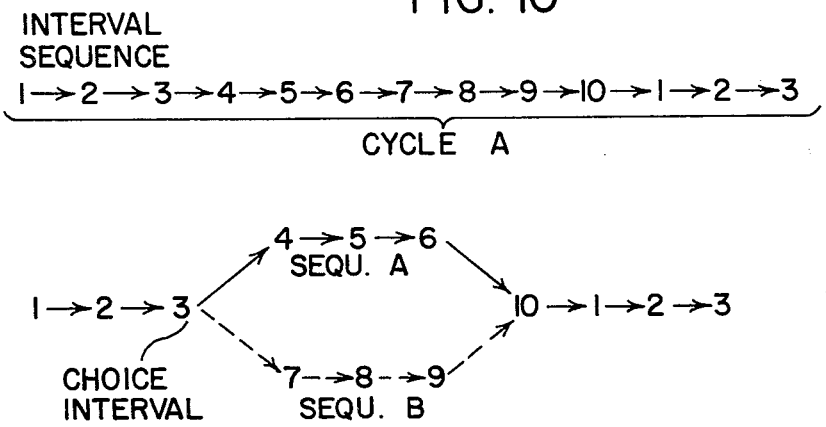
FIG. 10 is an interval sequence chart showing a fixed cycle employed in a preferred embodiment of the present invention and a sequence selectability characteristic which can be used in accordance with one aspect of the present invention.
Figure 11:
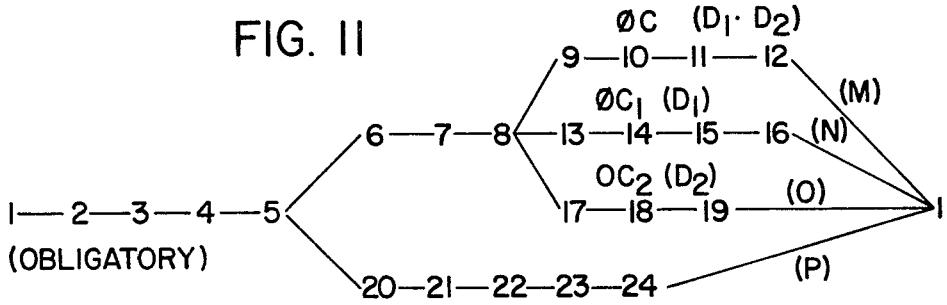
Figure 12:
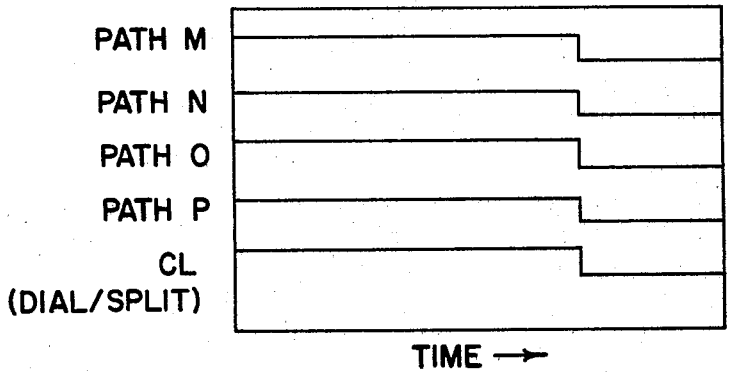
FIG. 12 is a compatibility chart showing the summation of various interval sequences in FIG. 11 as they are compared with the preselected cycle lengths in the timing plan of the preferred embodiment of the present invention.

Referring now to FIGS. 10–13, another aspect of the present invention is illustrated. In FIG. 10, a selected cycle is schematically indicated to have ten separate intervals which are processed in sequence. The cycle progresses through intervals Nos. 1–10. Thereafter, this cycle is repeated. This is in accordance with standard practice in a pretimed controller of the electro-mechanical or programmed type. This pretimed cycle process is employed in controller C constructed in accordance with the invention; however, up to twenty-four separate intervals may be used as shown in FIG. 4. For purposes of illustration, in interval No. 3, a choice can be made to determine whether or not the controller progresses through interval sequence A including interval No. 4, No. 5 and No. 6 or sequence B including intervals No. 7, No. 8, and No. 9. Each of these separate paths or branches require the same amount of cycle time so that the total cycle length CL between interval No. 1 and interval No. 10 is fixed. The chart in FIG. 10 is representative in nature and illustrates that one of the intervals, interval No. 3, in this example, allows a choice between each of two separate paths or interval sequence. This choice is made dependent upon external devices, such as detectors D1, D2. In practice, this aspect of the invention is incorporated in a method which operates in accordance with the chart shown in FIG. 11. Four separate paths are provided for a given cycle. Each of these paths M, N, O. and P include obligatory intervals Nos. 1–5. A choice is made at interval No. 5 to progress either to interval No. 6 or to interval No. 20. This is determined by traffic conditions as generally set forth in FIG. 3. If the path progresses to interval No. 6, a second decision or choice interval No. 8 allows shifting into intervals No. 9, No. 13 or No. 17. One constriction on the selection of separate sequences M, N, O and P is that the time between interval No. 5 and interval No. 1 is fixed. Thus, the cycle length CL is fixed irrespective of the selected path of intervals followed. This concept is schematically illustrated in FIG. 12 wherein cycle length CL is equal to the total duration to process the intervals in each separate, selectable interval paths M, N, O and P. Thus, even though controller C is pretimed, it can respond to vehicle and pedestrian detection calls to become an actuated pretimed controller without jeopardizing the fixed cycle length. In other pretimed controllers, the path of the intervals through any cycle is fixed. Utilizing the scheme as set forth in FIGS. 10 and 11, the cycle length is fixed but the sequence or path through the cycle is not fixed. As long as the cycle length remains constant there is a coordination between the movement of traffic through intersection TI with respect to other local controllers of the electro-mechanical type. This modification of a programmable pretimed controller produces a demand sensitive pretimed controller without destroying the compatibility with other pretimed units and with existing electro-mechanical controllers.

Referring to FIG. 3, if a call is received from both detectors D1, D2, interval path M is actuated. This path progresses from the obligatory intervals to choice interval No. 5 then through intervals Nos. 6–12, in succession. If a call is received only from detector D1, path N is followed. This path progresses from choice interval No. 8 to interval No. 13. If a detection from detector D2 is sensed interval path O is followed. If no detector call is received, path P is followed. This allows the time which would have used paths M, N and O to be split between street "A" and street "B". Since the length of each interval path must be equal, an attempt to enter the alternate paths into RAM 54 will be precluded if all selectable interval paths are not equal. This produces error EO9 in display 22 before entry of data can be made into the RAM for processing. The processing of the paths in accordance with the concept is stored permanently in EPROM 52.

Figure 13:
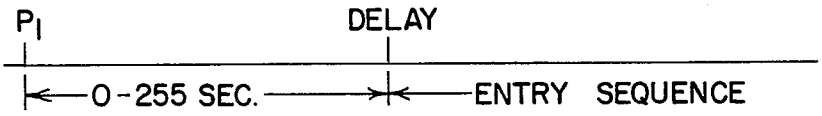
FIG. 13 is a timing chart illustrating an aspect of a pre-empt interrupt characteristic employed in the preferred embodiment of the present invention.

Another feature of the preferred embodiment of the invention is illustrated in FIG. 13, wherein a pre-emptive signal is received and a programmed delay of 0–255 seconds is used before the pre-emption signal allows entry into the cycle being processed. This delay feature allows for a selection of the proper time for shifting from the normal signal plan being processed to a special pre-emptive signal plan (No. 5). Referring back to FIG. 8, each timing interval will have a duration a. Time or duration b is the period after the minimum time has expired and the end of an interval period. Time c is after interval NA. According to the signal plan stored in the EPROM, each of the separate intervals is provided with programmed constrictions indicating whether or not the pre-emption signal plan can be started during periods a, b or c of the interval. Thus, each of the intervals is provided with a characteristic indicating its compatibility with a requested pre-emption signal. This is combined with the delay as shown in FIG. 13, and further controls the instance of shifting into the pre-emption signal plan. No known pretimed controllers utilizing software to simulate a mechanical camshaft shift into a pre-emption signal plan. Indeed, they do not shift in accordance with the concepts of the present invention.

Figure 14:
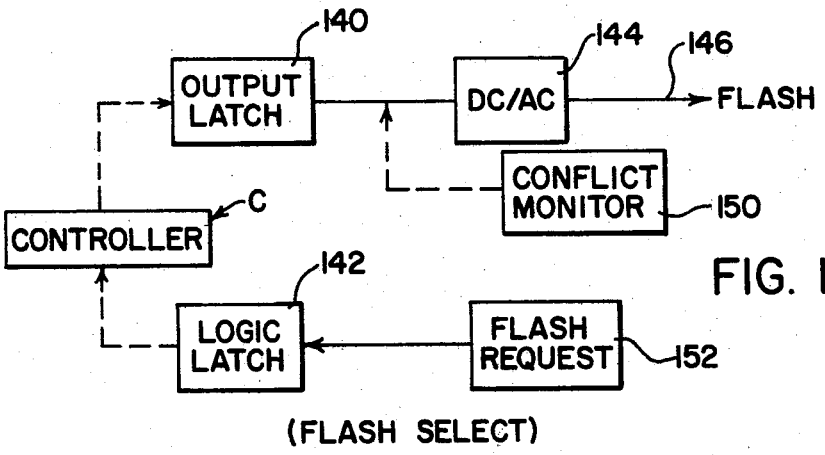
FIG. 14 is a block diagram illustrating another aspect of the preferred embodiment of the present invention for providing compatibility with existing electro-mechanical pretimed controllers.

FIG. 14 represents a schematic layout as used in practice in conjunction with controller C for using an external conflict monitor. In accordance with this concept, output latch 140 and input logic latch 142 are connected to the input/output interface 56 shown in FIG. 5. When controller C, in accordance with a signal plan, indicates that a flashing condition shall exist at intersection TI, this information is set in output latch 140. A Converter 144 converts the D.C. logic to an A.C. signal in line 146. This causes a flashing condition for the intersection. This flashing condition can be caused by the output of a separately mounted conflict monitor 140 which produces an input signal to converter 144 when there is a conflict situation in accordance with standard practice in traffic control. If there is an external request or demand for a flashing condition at intersection TI, a signal is received by a flash request device 152 which sets the logic in latch 142. When controller C processes through the executive program and determines that latch 142 has been set, intersection TI is converted to the flash condition by appropriate output logic in latch 140. In this manner, controller C is made compatible with existing electro-mechanical controller facilities and their associated conflict monitors such as represented by monitor 150 in FIG. 14.

Another interfacing concept is employed in accordance with the present invention and shown in FIG. 15. An output latch 160 controls the advance or step from one interval to another in a cycle being processed by controller C. In accordance with this concept, an interval advance signal causes latch 160 to be set. A separate advance latch 162 receives the signal from latch 160 and advances controller C to the next interval. This can be done automatically by providing a D.C. to A.C. converter 170 and an A.C. converter 172. Switch 180 is shifted into the automatic position "A" which directs the output of converter 170 directly to the input of converter 172. Thus, a signal strobed or otherwise deposited into latch 160 produces an A.C. signal at the input of converter 172 which is detected by latch 162. This advances controller C to the next interval. If selector switch 180 is shifted into the manual position "M", automatic interval stepping upon the periodic creation of an advance signal at latch 160 will not occur. Only by closing pushbutton 190 can an advance signal from line L2 be directed back to the converter for stepping the controller into the next interval. Since the advance signal is created at once, the pushbutton 190 can shift or step the controller from interval to interval upon pushing of the button. Other arrangements could be made for external operation of controller C by a traffic control person at intersection TI.

The various modes of operation performed in accordance with the present invention can be performed by any of the existing solid-state programmable controllers which are modified in accordance with the present disclosure. These methods produce a solid-state, pretimed, programmed controller having specific actuation capabilities allowing the pretimed controller to be substituted for an existing electro-mechanical controller or used at an intersection of the type which heretofore would have required the relatively expensive pretimed electro-mechanical controller.

Having thus described the invention the following is claimed:

1. In a digital pretimed traffic controller of the type used to control traffic signals at an intersection during a selected signal cycle, said controller including a central processing unit, a read only memory means for storing the executive program for said controller and a plurality of programmed solid state camshaft simulating signal plans each having a number of distinct intervals to be processed in sequence during a cycle of said controller, a random access read/write memory means for storing a rotary dial simulating timing plan having stored duration times for each of said distinct intervals of each of said signal plans stored in said read only memory means, external cycle select means for activating one of said signal plans and one of said timing plans for processing by said controller in accordance with said stored executive program, and interfacing means for controlling the condition of said traffic signals in accordance with the selected cycle being processed by said controller, the improvement comprising: detector means for directing a demand signal to said controller, means for providing a plurality of different interval sequences in a selected portion of the selected cycle being processed and means for selecting one of said interval sequences in response to said demand signal.

2. The improvement as defined in claim 1 wherein said given cycle has an initial portion with intervals to be processed before said selected sequence of intervals.

3. The improvement as defined in claim 2 wherein the summation of the duration time of said initial intervals and the duration time of said selected sequence of intervals has a constant cycle length time.

4. The improvement as defined in claim 1 wherein said selected cycles each have the same cycle length time.

5. The improvement as defined in claim 1 wherein said signal plan stored in said read only memory means includes minimum times stored for each interval.

6. The improvement as defined in claim 1 including means for receiving a preemption signal and means responsive to said preemption signal for shifting from one signal plan to another signal plan.

7. The improvement as defined in claim 6 including means for delaying said signal plan shift a predetermined time.

8. The improvement as defined in claim 6 including means for preventing said signal plan shift during certain portions of said signal plan.

9. The improvement as defined in claim 1 including means for setting a cycle length time in a given timing plan, means for comparing the summation of the distinct intervals in said given timing plan with said set cycle length and means for creating a signal when said summation is different from said set cycle length time of said given timing plan.

10. In a digital pretimed traffic controller of the type used to control traffic signals at an intersection during a signal cycle, said controller including a central processing unit, a read only memory means for storing the executive program for said controller and a plurality of programmed solid state camshaft simulating signal plans each having a number of distinct intervals to be processed in sequence during a cycle of said controller, a random access read/write memory means for storing a rotary dial simulating timing plan having stored duration times for each of said distinct intervals of each of said signal plans stored in said read only memory means, external cycle select means for activating one of said signal plans and one of said timing plans for processing by said controller in accordance with said stored executive program, and interfacing means for controlling the condition of said traffic signals in accordance with the selected cycle being processed by said controller, the improvement comprising: means for adjusting the cycle length time of a selected cycle, means for individually setting the time duration of each individual interval in said selected cycle and means for preventing processing of said selected cycle if said cycle length is different in time from the summation of the duration of said intervals of said selected cycle.

11. In a digital pretimed traffic controller of the type having a central processing unit, a read only memory means for storing the executive program for said controller and a plurality of programmed solid state camshaft simulating signal plans each having a number of distinct intervals to be processed in sequence during a cycle of said controller, a random access read/write memory means for storing a rotary dial simulating timing plan having stored duration times for each of said distinct intervals of each of said signal plans stored in said read only memory means, external cycle select means for activating one of said signal plans and one of said timing plans for processing by said controller in accordance with said stored executive program, and interfacing means for controlling the condition of said traffic signals in accordance with the selected cycle being processed by said controller, the improvement comprising: a means for storing a digital interval advance signal; first converting means for converting said digital advance signal into an alternating current advance signal; conductor means external of said controller for directing said alternating current advance signal to a manually operating switch having an automatic interval advance position; second converting means for converting said alternating current advance signal into a digital advance signal for use by said controller; and means for directing said alternating current advance signal from said first converting means to said second converting means when said switch is shifted into said automatic interval advance position.

* * * * *